US009793649B1

(12) United States Patent
Lin et al.

(10) Patent No.: US 9,793,649 B1
(45) Date of Patent: Oct. 17, 2017

(54) ROTATABLE PLUG STRUCTURE FOR POWER ADAPTER

(71) Applicant: Chicony Power Technology Co., Ltd., New Taipei (TW)

(72) Inventors: Yu-Jan Lin, New Taipei (TW); Po-Sheng Lee, New Taipei (TW)

(73) Assignee: CHICONY POWER TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 15/372,264

(22) Filed: Dec. 7, 2016

(30) Foreign Application Priority Data

Aug. 22, 2016 (TW) ..... 105212756 U

(51) Int. Cl.

| | |
|---|---|
| ***H01R 13/44*** | (2006.01) |
| ***H01R 13/60*** | (2006.01) |
| ***H01R 24/28*** | (2011.01) |
| ***H01R 13/05*** | (2006.01) |
| *H01R 103/00* | (2006.01) |

(52) U.S. Cl.
CPC ..... *H01R 13/60* (2013.01); *H01R 13/055* (2013.01); *H01R 24/28* (2013.01); *H01R 2103/00* (2013.01)

(58) Field of Classification Search
CPC ..... H01R 13/60; H01R 13/055; H01R 35/04; H01R 24/28; H01R 13/44; H01R 13/5213; H01R 31/066
See application file for complete search history.

(56) References Cited

U.S. PATENT DOCUMENTS

| | | | | |
|---|---|---|---|---|
| 4,997,381 | A * | 3/1991 | Oh | H01R 27/00 439/131 |
| 5,494,449 | A * | 2/1996 | Chioo | H01R 13/5213 439/131 |
| 6,312,271 | B1 * | 11/2001 | Tseng | H01R 13/44 439/131 |
| 7,125,266 | B1 * | 10/2006 | Huang | H01R 35/04 439/131 |
| 7,787,238 | B2 * | 8/2010 | Liao | H01R 31/065 174/50 |
| 8,979,549 | B2 * | 3/2015 | Lin | H01R 13/5045 439/31 |

* cited by examiner

*Primary Examiner* — Jean F Duverne
(74) *Attorney, Agent, or Firm* — Chun-Ming Shih; HDLS IPR Services

(57) ABSTRACT

A rotatable plug structure for a power adapter includes a carrying base, two conductive terminals and a plug. The carrying base includes a first installation slot, a second installation slot and a channel connected between the two. The conductive terminals are secured onto the first and second installation slots; the conductive terminals include a main body, a wiring portion and a clamping member. The clamping member includes a pair of metal slats bent from the main body and extended to taper toward each other. The plug is rotatably installed on the carrying base and the conductive terminal; the plug includes a pivotal axle, a pair of insertion pins and a conductive connecting end. The plug swings freely about the pivotal axle between a deployed state and a retracted state; thereby, the conductive connecting ends are clamped by the clamping member or disengaged therefrom to overcome the improper contact problem.

11 Claims, 9 Drawing Sheets

ROTATABLE PLUG STRUCTURE FOR POWER ADAPTER

BACKGROUND OF THE INVENTION

Field of the Invention

The present invention is related to a power adapter, in particular, to a rotatable plug structure in a power adapter.

Description of Related Art

A known power adapter having a rotatable connector comprises a housing, a rotating axle, two insertion pins and two conductive terminals attached onto the rotating axle. The housing includes two ping slots arranged spaced apart from each other inside the housing. The rotating axle is able to rotatably contact with the two conductive terminals for conduction or disengagement. During the use, the external ends of the two conductive terminals penetrate into the power connector of the power supply, and the external ends of the two insertion pins protrude out of the pin slots and are inserted into the socket. Accordingly, at this time, the pins and terminals contact with each other for conduction; therefore, the power in the socket can be transmitted to the power supply via the pins and the terminals sequentially. However, since the insertion pins and the conductive terminals only form conduction on one end thereof; therefore, the positions of the pins or terminals are likely to be deviated due to collision or various causes such that the corresponding pins and terminals cannot form contacts successfully, resulting in disconnection of power and the failure of the use of the device.

In view of the drawbacks of poor usage stability and insufficient structure associated with the currently existing known art of the rotatable connector of a power adapter, it is an objective of the inventor of the present invention to provide a solution capable of overcoming the aforementioned problems through years of research along with the utilization of theoretical principles.

SUMMARY OF THE INVENTION

The primary objective of the present invention is to provide a rotatable plug structure for a power adapter such that by changing the contact method between the plug and the conductive terminals, deformations caused by collisions of external forces or the problem of improper contacts due to assembly tolerances can be prevented.

To achieve the aforementioned objective, the present invention provides a rotatable plug structure for a power adapter, comprising a carrying base, two conductive terminals and a plug. The carrying base includes a first installation slot, a second installation slot and a channel connected between the first and the second installation slots. The two conductive terminals are secured onto the first installation slot and the second installation slot respectively; each one of the conductive terminals includes a main body, a wiring portion and a clamping member. The clamping member is formed by a pair of metal slats bent from the main body and extended to taper toward a direction approaching each other. The plug is rotatably installed on the carrying base and configured on the conductive terminal; the plug comprises a pivotal axle arranged in the channel and attaching to two sides of the carrying base as well as a pair of insertion pins secured on the pivotal axle and having a conductive connecting end. In addition, the plug is configured to swing freely about the pivotal axle in order to have a deployed state and a retracted state such that the conductive connecting ends are clamped by the clamping member or disengaged from the clamping member accordingly.

According to an embodiment of the present invention, wherein the main body includes at least one alignment hole formed thereon and disposed between the clamping member and the wiring portion; an area of the main body adjacent to the alignment hole is formed of a staged bending; the staged bending is a perpendicular bending or a slanted bending; the conductive terminals are secured by assembling the alignment holes onto the positioning members.

According to an embodiment of the present invention, wherein the clamping member comprises a holding portion, a bending portion and a gripping portion extended from the bending portion; the holding portion is formed by a pair of metal slats bent on two long sides of the main body and arranged vertically parallel to each other; the bending portion is formed by a metal slat bent at a rear end of the main body and arranged vertically; the gripping portion is formed at two ends of the bending portion and extended to taper toward a direction approaching corresponding sides of each other.

According to an embodiment of the present invention, wherein the clamping member comprises a holding portion, a bending portion and a gripping portion extended from the bending portion; the holding portion is formed by a pair of metal slats bent on two long sides of the main body adjacent to locations of the staged bending and arranged vertically parallel to each other; the bending portion is formed by a metal slat bent at a rear end of the main body and arranged vertically; the gripping portion is formed at two ends of the bending portion and extended to taper toward a direction approaching corresponding sides of each other.

According to an embodiment of the present invention, wherein the clamping member comprises a holding portion, a bending portion extended from the holding portion and a gripping portion extended from the bending portion; the holding portion is formed by a pair of metal slats bent on two long sides of the main body adjacent to locations of the staged bending and arranged vertically parallel to each other; the bending portion is formed by a metal slat bent at a rear end of the main body and arranged vertically; the bending portion extends from the holding portion in a direction toward the wiring portion and is bent at a direction approaching corresponding sides of each other; and the gripping portion is formed to extend from the bending portion and to taper toward a direction approaching corresponding sides of each other.

According to an embodiment of the present invention, wherein the conductive terminal further comprises a base pad portion, the base pad portion is a circular bending sheet member formed at an area of the main body adjacent to the bending portion. In addition, a height difference formed between the base pad portion and the main body is equivalent to a height difference formed between the staged bending and the main body.

According to an embodiment of the present invention, wherein a bending area of the bending portion is a bending end; a rear end of the gripping portion is a sloped bottom end; a slope section is formed to rise upward from the sloped bottom end to the bending end, and a flat section is formed to extend linearly from the slope section to the bending end; and an outward expanded fork is formed to extend from the slope bottom end of the gripping portion in a direction toward the holding portion.

According to an embodiment of the present invention, wherein two sides of the holding portion abut against an inner wall of the first installation slot and an inner wall of the second installation slot respectively.

According to an embodiment of the present invention, wherein the first installation slot and the second installation slot include a protruding platform protruded adjacent to a bottom wall of the channel respectively; the main body portion abuts against a top surface of the protruding platform respectively; a portion of the main body extended from the staged bending toward the wiring portion abuts against a bottom wall of the first installation slot and the second installation in order to form an elastic space between the main body and the bottom wall.

According to an embodiment of the present invention, wherein the first installation slot and the second installation slot include a protruding platform protruded adjacent to a bottom wall of the channel respectively; a bottom edge of the base pad portion abuts against a bottom wall of the first installation slot and the second installation slot; a portion of the main body extended from the staged bending toward the wiring portion abuts against the bottom wall of the first installation slot and the second installation respectively in order to form an elastic space between the main body and the bottom wall.

According to an embodiment of the present invention, wherein when the plug is under the deployed state, the plug uses the conductive connecting end to abut against the main body surface, and the gripping portion grips onto two sides of the conductive connecting end.

According to an embodiment of the present invention, wherein a positioning block radially protrudes on the pivotal axle between the pair of insertion pins; the carrying base includes a pair of positioning columns vertically extended therefrom and corresponding to a location of the positioning block; and when the plug is under the retracted state or under the deployed state, the plug uses the positioning block to abut against the pair of positioning columns in order to position the plug. In addition, the positioning block is able to allow the plug to generate a hand feel of resistance on a force application person during the rotation of the plug subject to the external force.

According to an embodiment of the present invention, wherein a circumferential wall of the first installation slot and the second installation slot further includes a notch in order to allow the conductive connecting end of the plug to pass by the notch on a swing path freely without obstacles.

In comparison to the known art, the present invention further includes the following technical effects: when the plug is under the deployed state, the rear end of the conductive connecting end is able to abut against the surface of the main body in order to form a three-face contact. In addition, with the elastic space, it is able to provide a compressible space when the conductive connecting end abuts against the surface of the main body in order to prevent improper contacts due to machining precision errors of the components or to prevent the problem of contact failure between components.

DETAILED DESCRIPTION OF THE INVENTION

The following provides detailed descriptions and technical contents of the present invention along with the accompanied drawings. However, it shall be understood that the accompanied drawings are provided for reference and illustration purpose only such that the drawings shall not treated as limitations of the present invention.

Figure 1:
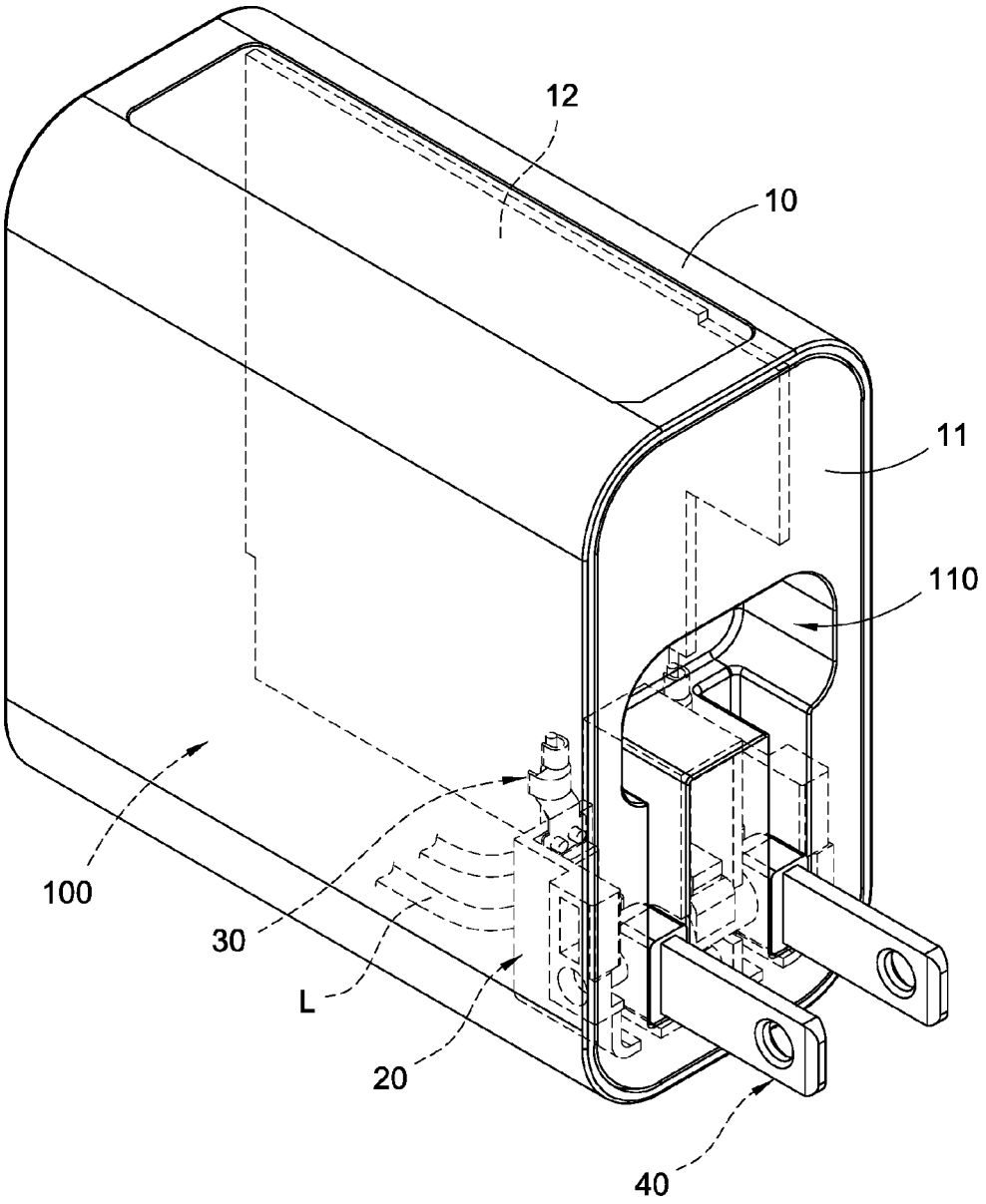
FIG. 1 is an assembly perspective view of a power adapter with a rotatable plug structure of the present invention.
Figure 4:
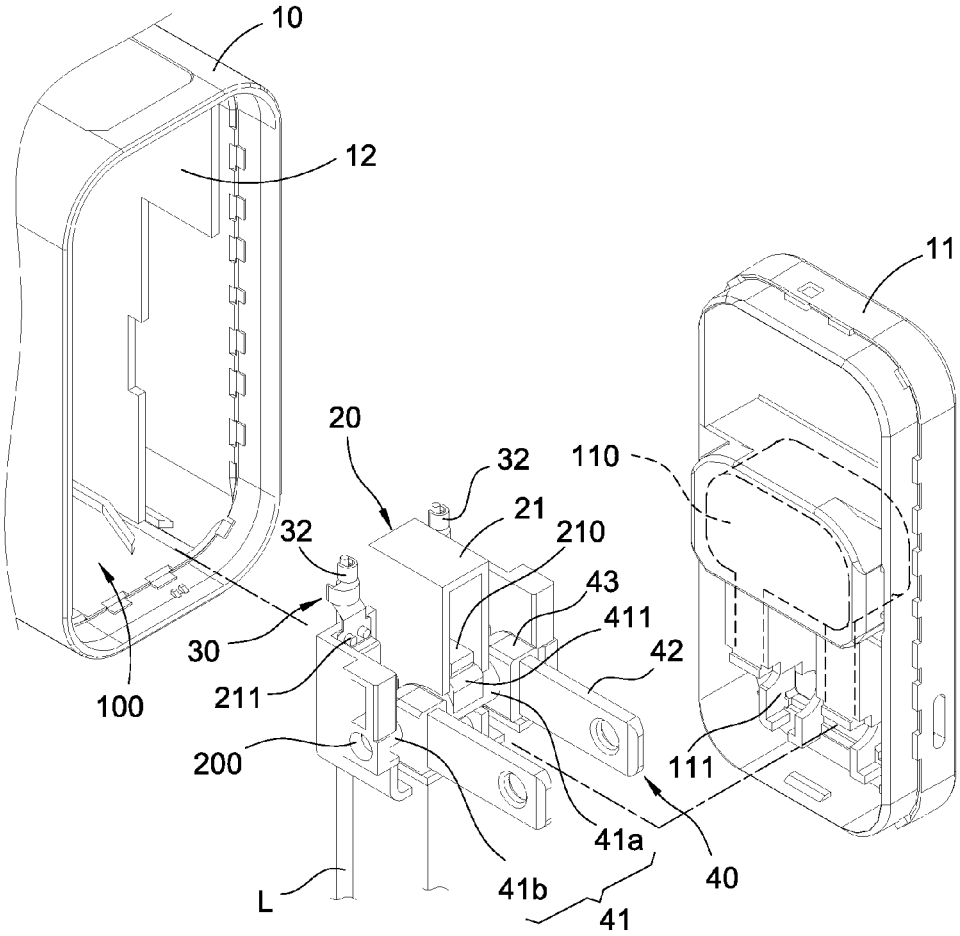
FIG. 4 is an assembly perspective view of the rotatable plug structure of the present invention.

As shown in FIG. 1, the present invention provides a rotatable plug structure for a power adapter. The power adapter comprises a housing 10 and a cover member 11 assembled onto the housing 10. The housing 10 includes an accommodation space 100 and a circuit integrated module 12 installed therein. The cover member 12 includes a receiving slot 110, and the receiving slot 110 includes two slot holes 111 formed thereon (as shown in FIG. 4) for connecting to the accommodation space 100. In addition, the rotatable plug structure of the present invention is arranged at a location inside the accommodation space 100 adjacent to the receiving slot 110. In this embodiment, the rotatable plug structure comprises a carrying base 20, two conductive terminals 30 and a plug 40. The plug 40 can be rotatably exposed at the external of the receiving slot 110 from the two slot holes 111 or can be retracted into the aforementioned receiving slot 110.

Figure 2:
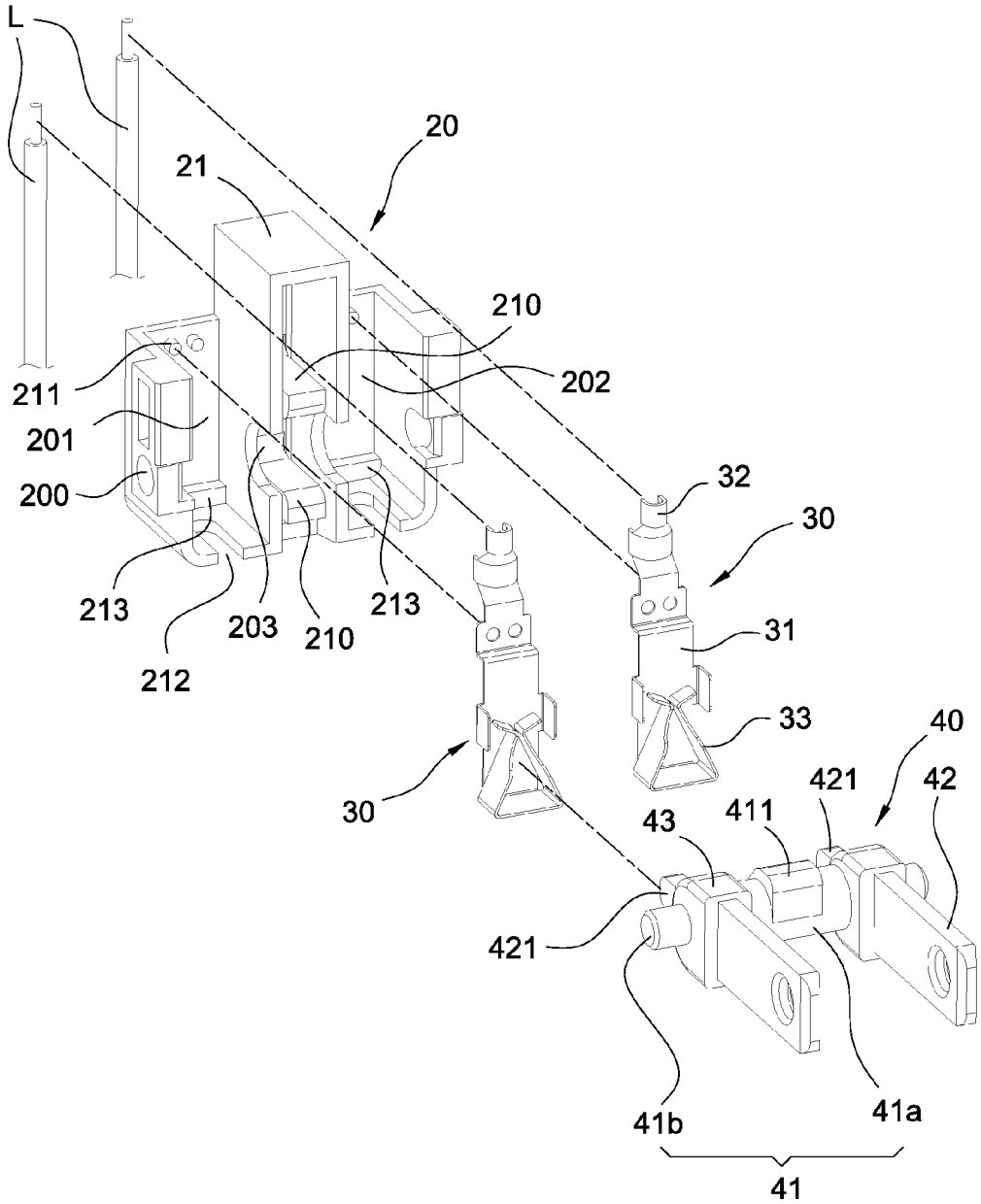
FIG. 2 is an exploded perspective view of one side of the power adapter with a rotatable plug structure of the present invention.

As shown in FIG. 2, a hollow separating block 21 is formed between the two sides of the carrying base 20. In addition, a first installation slot 201 and a second installation slot 202 are formed a separating block 21 corresponding to two sides of the carrying base 20. Moreover, a channel 203 of a curved indentation shape is formed on the top portion of the separating block 21 in order to connect with the first installation slot 201 and the second installation slot 202. The areas of the two side walls of the carry base 20 corresponding to the channel 203 include an axle receiving hole 200 formed thereon respectively. The bottom walls of the first installation slot and the second installation slot 202 are formed of at least one securement member 211 respectively. The securement member 211 can be a circular protrusion protruded outward from the aforementioned bottom wall; however, it is not limited to such configuration only. Furthermore, the bottom wall of hollow portion of the separating block 21 adjacent to the location of the channel 203 includes a pair of corresponding positioning columns 210 extended vertically. IN addition, the bottom walls of the first installation slot 201 and the second installation slot 202 adjacent to the channel 203 includes a protruding platform 213 protruded therefrom respectively. The protruding platform 213 can be selectively connected to or not connected to each one of the inner circumferential walls of the first installation slot 201 and the second installation slot 202; however, it is not limited to such configuration only.

Figure 3:
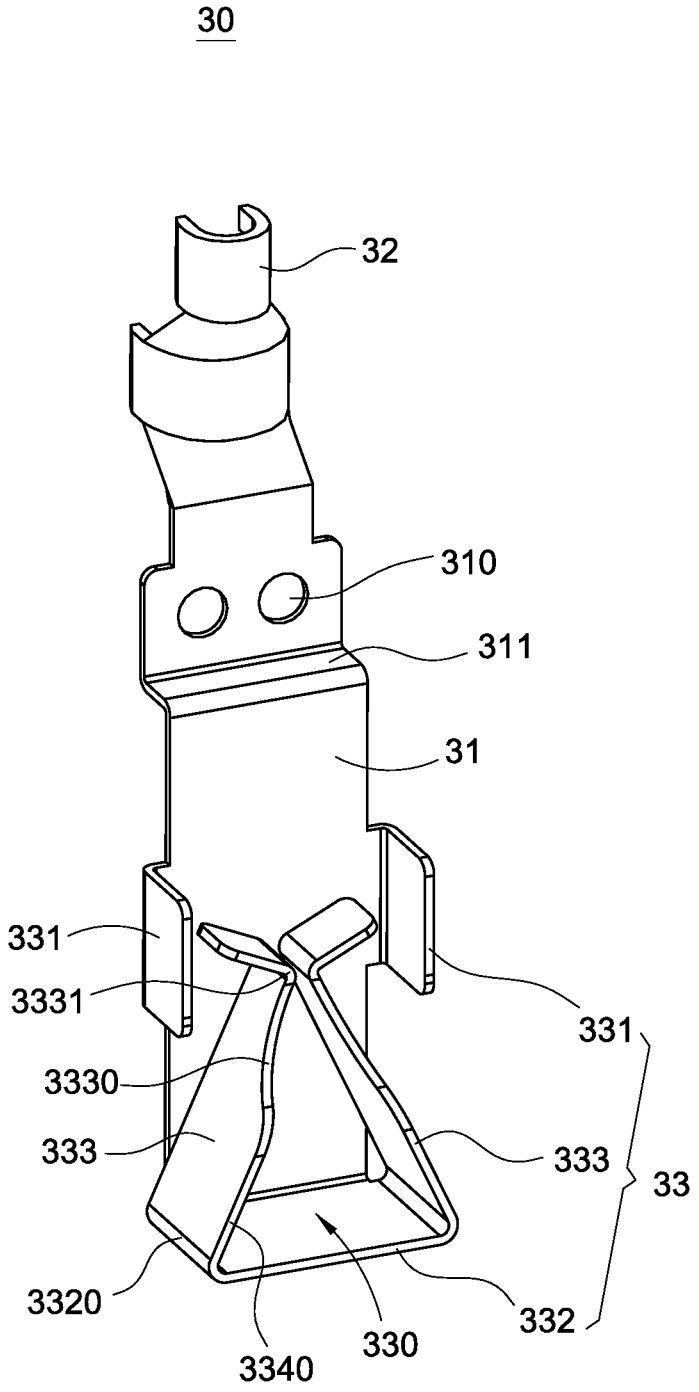
FIG. 3 is a perspective view of one embodiment of the conductive terminal of the present invention.
Figure 5:
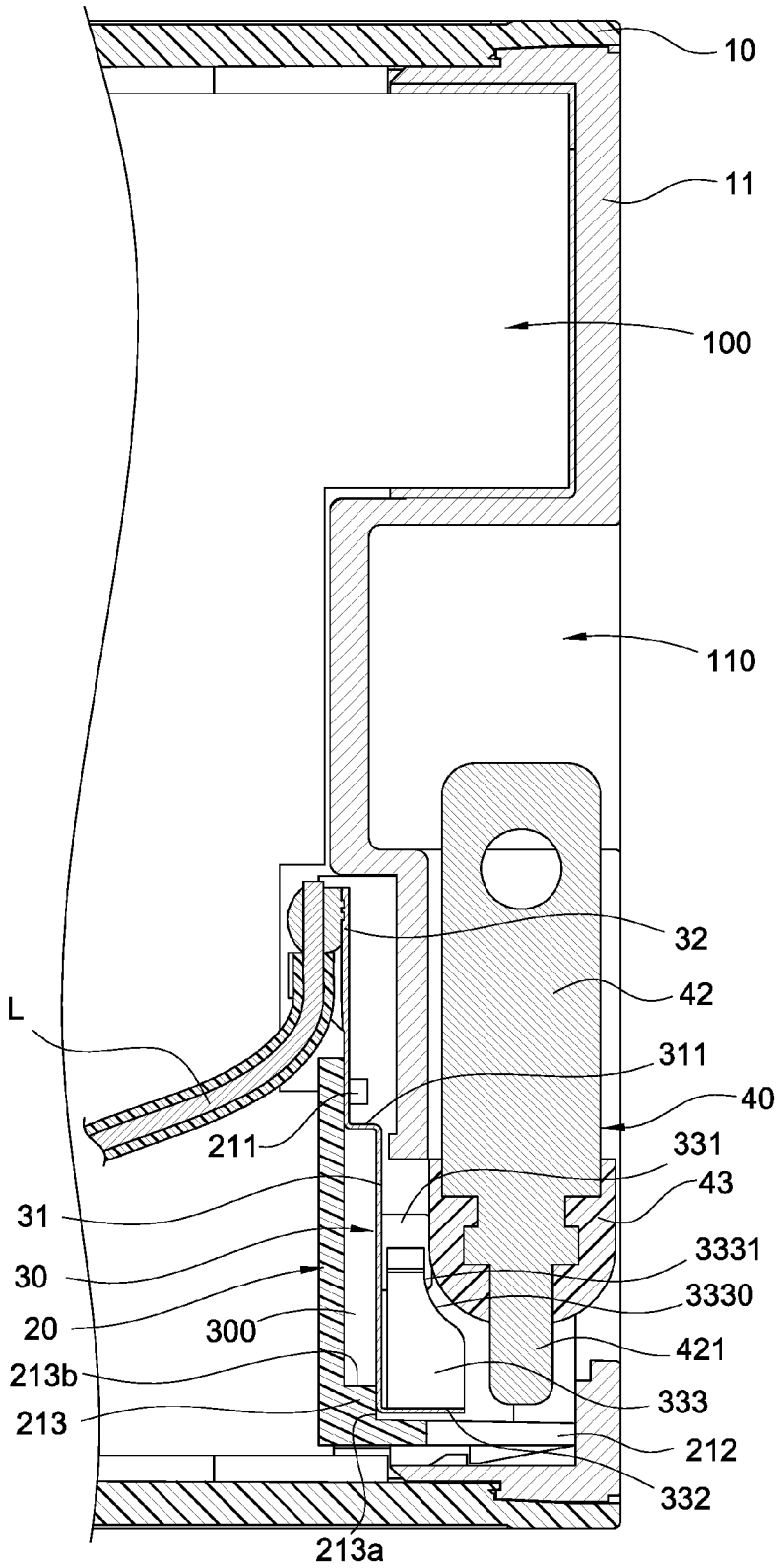
FIG. 5 is a cross sectional side view of the rotatable plug structure of the present invention under a retracted state.

As shown in FIG. 3, the conductive terminal 30 comprises a main body 31 made of a metal material, a wiring portion 32 arranged on one end of the main body 31 and a clamping member 33 arranged on another end thereof. The wiring portion 32 provides a conductive wire L (as shown in FIG. 5) mounted and secured thereon, and the conductive wire L is electrically connected to the aforementioned circuit integrated module 12. The area of the surface of the main body 31 corresponding to the aforementioned securement member 211 is formed of at least one alignment hole 310, and it is disposed between the clamping member 33 and the wiring portion 32. Furthermore, the main body 31 adjacent to the alignment hole 310 is formed of a staged bending 311. The staged bending 311 can be a perpendicular bending or a slanted bending. In this embodiment, the perpendicular bending is used for illustration. The length of the perpendicular bending matches with the height of the protruding platform 213 in the first installation slot 201 and the second installation slot 202. Moreover, the clamping member 33 is formed of a pair of metal slats bent from the main body 31 of the conductive terminals 30 and extended to taper toward a direction approaching each other According to the above, the alignment holes 310 are provided for the aforementioned circular protrusions to penetrate therethrough in order to allow the two conductive terminals 30 to secure onto the first installation slot 201 and the second installation slot 202 respectively. In addition, the main body 31 partially abuts against a top surface 213*a* of the aforementioned protruding platform, and a portion of the main body 31 extended from the staged bending 311 toward the wiring portion 32 abuts the bottom walls of the first installation slot 201 and the second installation slot 202 in order to allow the portion of the main body 31 not abutted against the aforementioned bottom wall to form an elastic space 300 with the aforementioned bottom wall.

According to the above, the aforementioned clamping member 33 comprises a holding portion 331, a bending portion 332 and a gripping portion 333 extended from the bending portion 332. The holding portion 331 is formed of a pair of metal slats bent from the two long sides of the main body 31 of the conductive terminal 30 and arranged vertically parallel to each other. Each metal slat abuts against the inner walls of the first installation slot 201 and the second installations slot 202 respectively. The bending portion 332 is a metal slat bent from the rear end of the main body 31 of the conductive terminal 30 and arranged vertically; two ends of the metal slat extend to connect to the gripping portion 333 and are bent at the aforementioned connecting area in a direction toward the wiring portion 32. In addition, the gripping portion 333 is formed of two metal slats extended from two ends of the metal slat of the bending portion 332 and tapered toward a direction approaching the corresponding sides of each other, and a clamping space 330 is formed between the two metal slats; the clamping space 330 is of a triangular space profile.

To be more specific, the bending area of the aforementioned bending portion 332 is defined as a folding end 3320. Each one of the rear ends of the two metal slats of the gripping portion 333 is a sloped bottom end 3331. A slope section 3330 rising upward is formed from the sloped bottom end 3331 to the folded end 3320, and a flat section 3340 linearly extends from the slope section 3330 and connects to the folded end 3320. In addition, an outward expanded fork is formed from the sloped bottom end 3331 of the gripping portion 333 toward a direction of the holding portion 331 respectively.

As shown in FIG. 4, the plug 40 is rotatably assembled onto the carrying base 20 and is configured on the conductive terminal 30. The plug 40 comprises a pivotal axle 41, a pair of insertion pins 42 and a pair of insulative sleeves 43. The pivotal axle is arranged inside the channel 203 of the carrying base 20 and comprises a main axle 41*a* and two end portions 41*b* extended from the main axle. The main axle 41*a* is covered with each one of the insulative sleeves and the two end portions protrude out of the insulative sleeves 43 in order to pivotally attach onto the two axle receiving holes 200 of the axle receiving base 20. Each insertion pin 42 protrudes from the two ends of the pair of insulative sleeves 43 and one of two ends is a conductive connecting end 421.

According to the above, the plug 40 uses the pivotal axle 41 to swing freely in order to have a deployed state and a retracted state such that the side surfaces of each conductive connecting end 421 of each insertion pin 42 are firmly gripped by the gripping portion 333 or disengage from the clamping space 330 of the clamping member 33; wherein the swing angle of the aforementioned swing is determined based on the carrying base or the structural design of the aforementioned receiving slot 110; therefore, it can be greater than 90 degrees or smaller than 90 degrees. Furthermore, a positioning block 411 radially protrudes from the pivotal axle 41 between each insertion pin 42 and is arranged corresponding to the aforementioned each positioning column 210. Moreover, when the plug 40 is under the retracted state or the deployed state, the blocking block 411 is forced to abut against the surface of the positioning column 210 in order to position the plug 40. In addition, during the process where a user applies a force on the plug to allow it to rotate, the surface of the positioning block 411 firmly abuts against one of the positioning columns 210 such that a hand feel of resistance is generated on the force application user during the application of the force thereon.

To be more specific, as shown in FIG. 2 again, the circumferential walls of the aforementioned first installation slot 201 and the second installation slot 202 adjacent to the clamping member 33 can be further provided with a notch 212 such that when the conductive connecting end 421 of the aforementioned insertion pin 42 is on the swing path under the deployed state or the retracted state, it is able to pass by the notch 212 in such way that the free swing space of the plug 40 would not be obstructed by the inner walls of the first installation slot 201 and the second installation slot 202.

As shown in FIG. 5, the two conductive terminals are secured onto the first installation slot 201 and the second installation slot 202 respectively, and the alignment hole 310 is mounted corresponding to the securement member 211 for securement thereof. The wiring portion 312 provides a conductive wire L secured therein, and the conductive wire L is electrically connected to the aforementioned circuit integrated module 12; at this time, the plug 40 is retraced inside the receiving slot 110 vertically.

Figure 6:
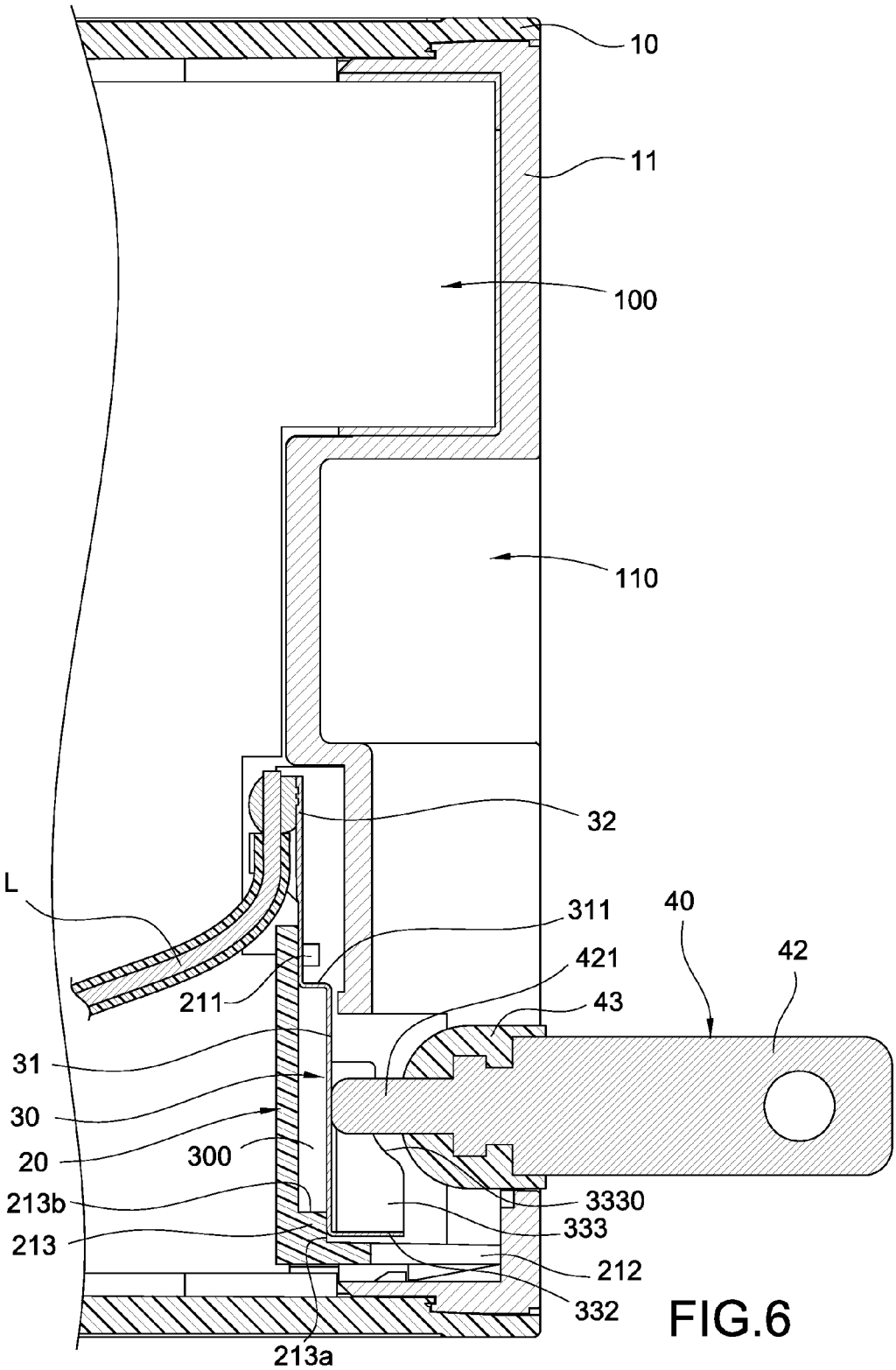
FIG. 6 is a cross sectional side view of the rotatable plug structure of the present invention under a deployed state.
Figure 7:
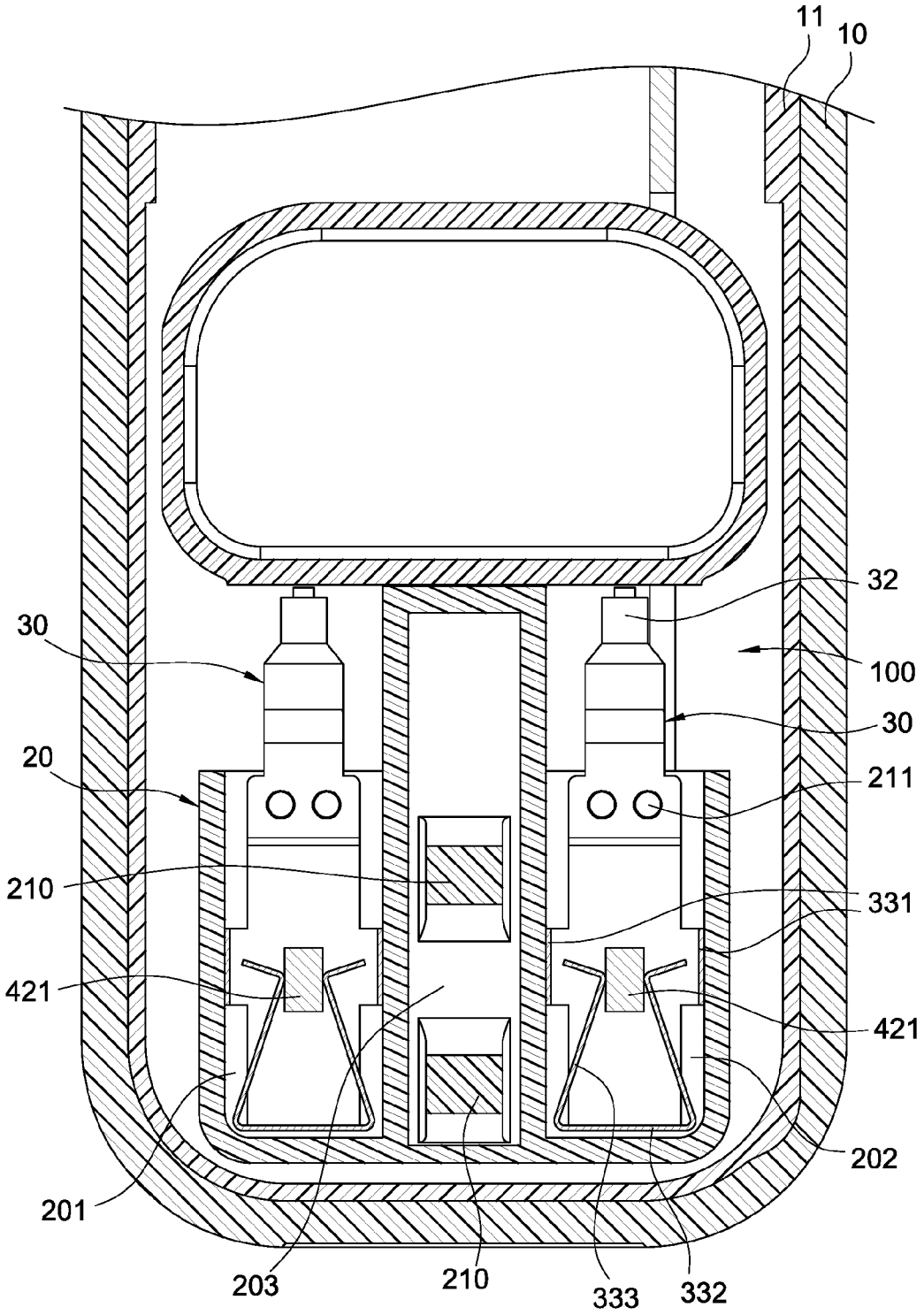
FIG. 7 is an upper cross sectional view of the rotatable plug structure of the present invention under a deployed state.

As shown in FIGS. 6 and 7, during the operation, the plug 40 uses the pivotal axle 41 as the rotational center to rotate outward such that each conductive connecting end 421 of each insertion pin 42 follows such rotation to be clamped inside the gripping portion 333 of the clamping member 33 in order to be griped firmly thereon.

The structural design of the pair of clamping members 33 of the rotational plug structure of the present invention is an improvement over the known art where the conductive connecting end uses the contact method of point-to-point between the conductive terminals or uses the single-side contact method; whereas the axial direction of the aforementioned contact method is the extension direction of the insertion pin. In this embodiment, the pair of clamping members 33 grip onto the two sides of the conductive connecting ends 421 in order to form a contact method of face-to-face such that a more stable contact can be established. In addition, since the axial direction of such contact surfaces is at the direction perpendicular to the insertion pin 42, it is able to further improve the problem of contact failure caused by deviation of the locations of the pins or terminals due to collisions or various reasons. Moreover, the rear end of the conductive contact end 421 under the deployed state can also abut against the surface of the main body 31 in order to form a three-surface contact, and with the aforementioned elastic space 300, a compressible space can be formed when the conductive contacting end 421 abuts against the surface of the main body 31 in order to prevent improper contacts caused by machining precision errors of the components or the problem of contact failure.

Figure 8:
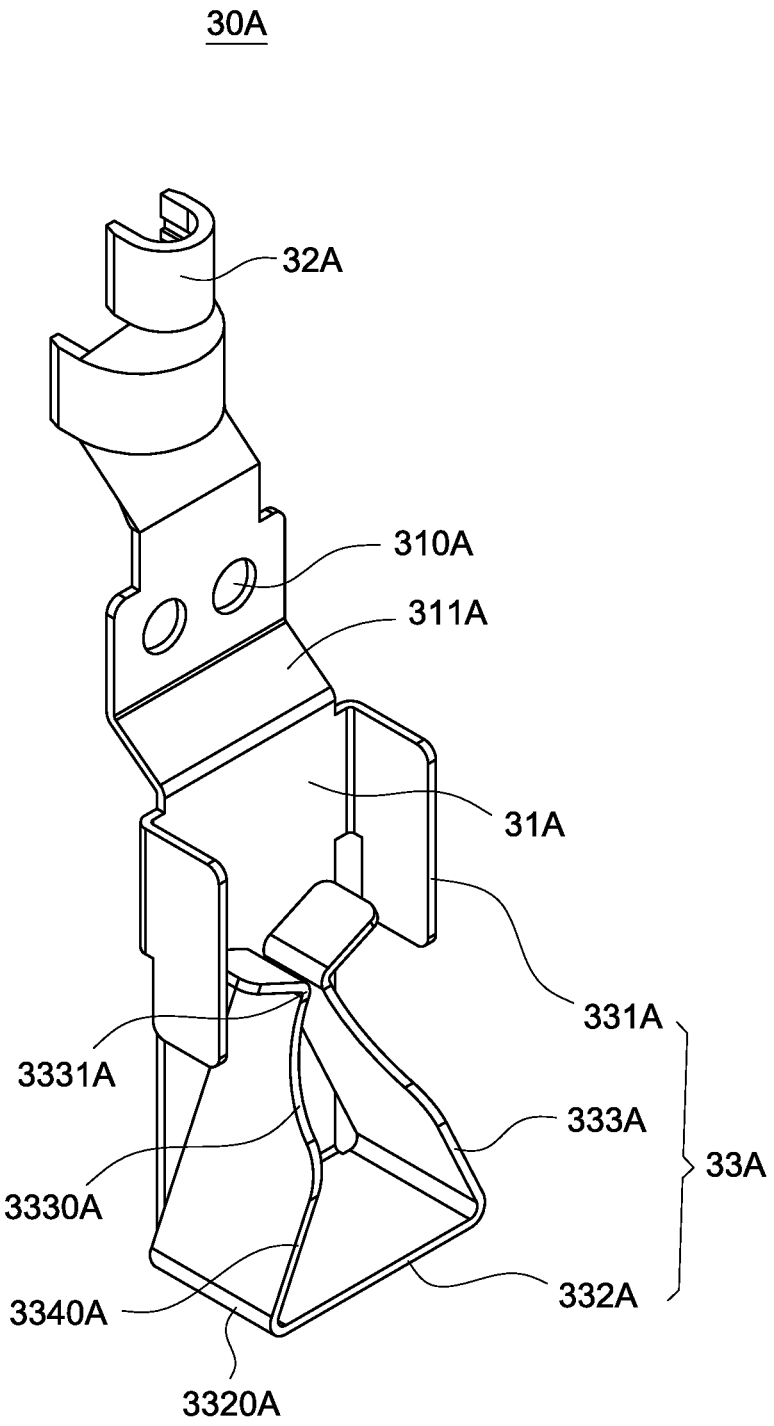
FIG. 8 is a perspective view of another embodiment of the conductive terminal of the present invention.

As shown in FIG. 8, in this embodiment, the rotatable plug structure comprises the aforementioned carrying base 20, two conductive terminals 30A and the aforementioned plug 40.

The conductive terminal 30A comprises a main body 31A, a wring portion 32A arranged on one end of the main body 31A and a clamping member 33A arranged on another end thereof. The surface of the main body 31A is formed of at least one alignment hole 310A corresponding to the aforementioned securement member 211. The clamping member 33A comprises a holding portion 331A, a bending portion 332A and a gripping portion 333A extended from the bending portion 332A. The bending portion 332A is bent from the holding portion 331A and in a direction away from the wiring portion 32A and toward the corresponding sides of the metal slat; wherein, the bending area of the bending portion 332A is defined to be a folded end 3320A. Each one of the rear ends of the two metal slats of the gripping portion 333A is a sloped bottom end 3331A, a slope section 3330A rising upward is formed from the sloped bottom end 3331A to the folded end 3320A, and a flat section 3340A extends from the slope section 3330A and connected to the folded end 3320A. Furthermore, the slope bottom end 3331A of the gripping portion 333A is formed of an outward expanded fork extended in a direction toward the holding portion 331A respectively.

According to the above, the main difference between this embodiment and the previous embodiment relies in that the main body 31A adjacent to the alignment hole 310A is formed of a staged bending 311A, and the staged bending 311A is a slanted bending. In addition, a height difference formed between the slanted bending and the main body 31A matches with a height of the protruding platform 213 in the aforementioned first installation slot 201 and the aforementioned installation slot 202. Furthermore, the holding portion 331A is formed of a pair of metal slats bent from the two long sides of the main body 31A adjacent to the location of the staged bending 311A and arranged vertically parallel to each other. Moreover, a length of the pair of the metal slats of the holding portion 331A is greater than a length of the pair of metal slats of the holding portion 331 in the previous embodiment, and the pair of metal slats abut against the inner walls of the first installation slot 201 and the second installation slot 202 respectively.

In this embodiment, it is also of the same technical effect as that of the previous embodiment. In addition, the structural design of the conductive terminal 30A has the additional merits of having a lower material cost and the technical effect of capable of increasing the upper impact buffering function.

Figure 9:
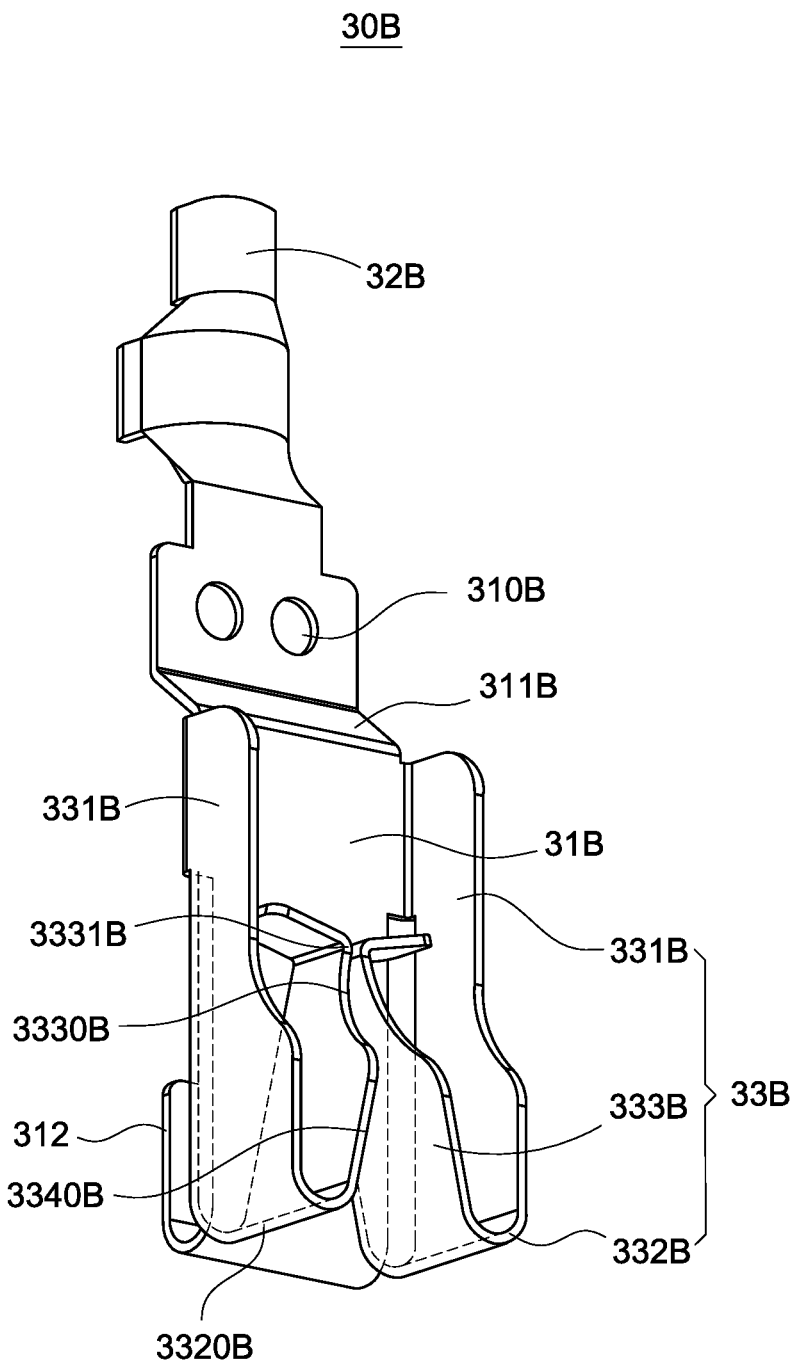
FIG. 9 is a perspective view of another embodiment of the conductive terminal of the present invention.

As shown in FIG. 9, in this embodiment, the rotatable structure of the present invention comprises the aforementioned carrying base 20, two conductive terminals 30B and the aforementioned plug 40.

The conductive terminal 30B comprises a main body 31B, a wring portion 32B arranged on one end of the main body 31B and a clamping member 33B arranged on another end thereof. The surface of the main body 31B is formed of at least one alignment hole 310B corresponding to the aforementioned securement member 211. The clamping member 33B comprises a holding portion 331B, a bending portion 332B and a gripping portion 333B extended from the bending portion 332B. The main body 31B adjacent to the location of the alignment hole 310B is formed of a staged bending 311B. The gripping portion 333B extends from the bending portion 332B and tapered toward a direction approaching the corresponding sides of the metal slats; wherein the bending area of the bending portion 332B is defined to be a folded end 3320B. Each one of the rear ends of the two metal slats of the gripping portion 333B is a sloped bottom end 3331B, a slope section 3330B rising upward is formed from the sloped bottom end 3331B to the folded end 3320B, and a flat section 3340B extends from the slope section 3330B and connected to the folded end 3320B. Furthermore, the slope bottom end 3331B of the gripping portion 333B is formed of an outward expanded fork extended in a direction toward the holding portion 331B respectively.

The main difference between this embodiment and aforementioned two previous embodiments relies in that the holding portion 331B is formed of a pair of metal slats bent from the two long sides of the main body 31B adjacent to the location of the staged bending 311B and arranged vertically parallel to each other. The pair of metal slats abut against the inner walls of the first installation slot 201 and the second installation slot 202 respectively, and the bending portion 332B extends from the pair of metal slats of the holding portion 331B and away from the wiring portion 32B as well as toward the bending portion formed on the sides corresponding to each other. Moreover, the conductive terminal 30B further comprises a base pad portion 312. The base pad portion 312 is a circular bending sheet member formed adjacent to the aforementioned bending end 3320B and arranged in a direction identical to that of the aforementioned staged bending 311B; wherein a height difference formed between the circular bending and the main body 31B matches with a height formed between the aforementioned staged bending 311B and the main body 31B in order to allow the bottom edge of the base pad portion 312 to abut against the bottom walls of the first installation slot and the second installation slot. Moreover, the surface of the bending portion thereof abuts against one side surface 213*b* of the aforementioned protruding platform 213, and the lower edge of the clamping member 33B abuts against the top surface 213*a* of the aforementioned protruding platform 213.

In this embodiment, it is also of the same technical effect as that of the previous embodiment. In addition, structural design of the conductive terminal 30B has the further merits of lower material costs and the technical effect of capable of increasing the upper impact buffering function.

To be more specific, all surfaces of the clamping member (33, 33A, 33B) of the aforementioned conductive terminals (30, 30A, 30B) of each one of the aforementioned embodiments are coated with conductive grease in order to reduce the contact resistance.

According to the above, with the structural design of the conducive terminal for changing the contact structure between the connector and the conductive terminal, the rotatable plug structure for a power adapter of the present invention has the following merits:

1. Capable of reducing improper contacts due to assembly tolerance;
2. Capable reducing improper contacts due to permanent deformation of the conductive terminal subject to impacts from the top thereof.

In view of the above, the rotatable plug structure for a power adapter of the present invention is capable of achieving the expected objectives and overcoming the drawbacks of known arts, which is of novelty and inventive step to satisfy the patentability for patent; therefore, the present application is legitimately applied in light of the grant of the patent right.

What is claimed is:

1. A rotatable plug structure for a power adapter, comprising:

a carrying base having a first installation slot, a second installation slot and a channel connected between the first and the second installation slots;

two conductive terminals secured onto the first installation slot and the second installation slot respectively; each one of the conductive terminals having a main body, a wiring portion arranged on one end of the main body and a clamping member arranged on another end of the main body; the clamping member formed by a pair of metal slats bent from the main body and extended to taper toward a direction approaching each other;

a plug rotatably installed on the carrying base and configured on the conductive terminal; the plug comprising a pivotal axle arranged in the channel and attaching to two sides of the carrying base as well as a pair of insertion pins secured on the pivotal axle; each one of the pair of insertion pins having a conductive connecting end; the plug configured to swing freely about the pivotal axle in order to have a deployed state and a retracted state such that the conductive connecting ends are clamped by the clamping member or disengaged from the clamping member accordingly, wherein the clamping member comprises a holding portion, a bending portion and a gripping portion extended from the bending portion; the holding portion is formed by a pair of metal slats bent on two long sides of the main body and arranged vertically parallel to each other; the bending portion is formed by a metal slat bent at a rear end of the main body and arranged vertically; the gripping portion is formed at two ends of the bending portion and extended to taper toward a direction approaching corresponding sides of each other;

wherein a bending area of the bending portion is a bending end; a rear end of the gripping portion is a sloped bottom end; a slope section is formed to rise upward from the sloped bottom end to the bending end, and a flat section is formed to extend linearly from the slope section to the bending end; and an outward expanded fork is formed to extend from the slope bottom end of the gripping portion in a direction toward the holding portion.

2. The rotatable plug structure for a power adapter according to claim 1, wherein the main body includes at least one alignment hole formed thereon and disposed between the clamping member and the wiring portion; an area of the main body adjacent to the alignment hole is formed of a staged bending; the staged bending is a perpendicular bending or a slanted bending.

3. The rotatable plug structure for a power adapter according to claim 1, wherein the conductive terminal further comprises a base pad portion, and the base pad portion is a circular bending sheet member formed at an area of the main body adjacent to the bending portion.

4. The rotatable plug structure for a power adapter according to claim 3, wherein a height difference formed between the base pad portion and the main body is equivalent to a height difference formed between the staged bending and the main body.

5. The rotatable plug structure for a power adapter according to claim 1, wherein two sides of the holding portion abut against an inner wall of the first installation slot and an inner wall of the second installation slot respectively.

6. The rotatable plug structure for a power adapter according to claim 1, wherein the first installation slot and the second installation slot include a protruding platform protruded adjacent to a bottom wall of the channel respectively; the main body portion abuts against a top surface of the protruding platform respectively; a portion of the main body extended from the staged bending toward the wiring portion abuts against a bottom wall of the first installation slot and the second installation in order to form an elastic space between the main body and the bottom wall.

7. The rotatable plug structure for a power adapter according to claim 3, wherein the first installation slot and the second installation slot include a protruding platform protruded adjacent to a bottom wall of the channel respectively; a bottom edge of the base pad portion abuts against a bottom wall of the first installation slot and the second installation slot; a portion of the main body extended from the staged bending toward the wiring portion abuts against the bottom wall of the first installation slot and the second installation respectively in order to form an elastic space between the main body and the bottom wall.

8. The rotatable plug structure for a power adapter according to claim 1, wherein the main body includes at least one alignment hole formed thereon and disposed between the clamping member and the wiring portion; the first installation slot and the second installation slot include a positioning member arranged corresponding to the alignment hole respectively; the conductive terminals are formed by assembling the alignment holes and the positioning members.

9. The rotatable plug structure for a power adapter according to claim 1, wherein a circumferential wall of the first installation slot and the second installation slot further includes a notch in order to allow the conductive connecting end of the plug to pass by the notch on a swing path freely without obstacles.

10. A rotatable plug structure for a power adapter, comprising:

a carrying base having a first installation slot, a second installation slot and a channel connected between the first and the second installation slots;

two conductive terminals secured onto the first installation slot and the second installation slot respectively; each one of the conductive terminals having a main body, a wiring portion arranged on one end of the main body and a clamping member arranged on another end of the main body; the clamping member formed by a pair of metal slats bent from the main body and extended to taper toward a direction approaching each other;

a plug rotatably installed on the carrying base and configured on the conductive terminal; the plug comprising a pivotal axle arranged in the channel and attaching to two sides of the carrying base as well as a pair of insertion pins secured on the pivotal axle; each one of the pair of insertion pins having a conductive connecting end; the plug configured to swing freely about the pivotal axle in order to have a deployed state and a retracted state such that the conductive connecting ends are clamped by the clamping member or disengaged from the clamping member accordingly, wherein the clamping member comprises a holding portion, a bending portion and a gripping portion extended from the bending portion; the holding portion is formed by a pair of metal slats bent on two long sides of the main body and arranged vertically parallel to each other; the bending portion is formed by a metal slat bent at a rear end of the main body and arranged vertically; the gripping portion is formed at two ends of the bending portion and extended to taper toward a direction approaching corresponding sides of each other;

wherein when the plug is under the deployed state, the plug uses the conductive connecting end to abut against the main body surface, and the gripping portion grips onto two sides of the conductive connecting end.

11. A rotatable plug structure for a power adapter, comprising:

a carrying base having a first installation slot, a second installation slot and a channel connected between the first and the second installation slots;

two conductive terminals secured onto the first installation slot and the second installation slot respectively; each one of the conductive terminals having a main body, a wiring portion arranged on one end of the main body and a clamping member arranged on another end of the main body; the clamping member formed by a pair of metal slats bent from the main body and extended to taper toward a direction approaching each other;

a plug rotatably installed on the carrying base and configured on the conductive terminal; the plug comprising a pivotal axle arranged in the channel and attaching to two sides of the carrying base as well as a pair of insertion pins secured on the pivotal axle; each one of the pair of insertion pins having a conductive connecting end; the plug configured to swing freely about the pivotal axle in order to have a deployed state and a retracted state such that the conductive connecting ends are clamped by the clamping member or disengaged from the clamping member accordingly, wherein a positioning block radially protrudes on the pivotal axle between the pair of insertion pins; the carrying base includes a pair of positioning columns vertically extended therefrom and corresponding to a location of the positioning block; and when the plug is under the retracted state or under the deployed state, the plug uses the positioning block to abut against the pair of positioning columns in order to position the plug.

* * * * *